US005941401A

United States Patent [19]

Petzold et al.

[11] Patent Number: 5,941,401

[45] Date of Patent: Aug. 24, 1999

[54] COUNTERWEIGHT HANDLING SYSTEM FOR RING SUPPORTED CRANES

[75] Inventors: Terry L. Petzold, Kiel; Jeffery L. Dreger, Manitowoc; John M. Lanning, Cato, all of Wis.

[73] Assignee: Manitowoc Crane Group, Inc., Reno, Nev.

[21] Appl. No.: 08/792,681

[22] Filed: Jan. 29, 1997

[51] Int. Cl.[6] ..... B66C 23/72

[52] U.S. Cl. ..... 212/178; 212/195

[58] Field of Search ..... 212/178, 195, 212/196, 197, 198, 301, 302

[56] References Cited

U.S. PATENT DOCUMENTS

| | | | |
|---|---|---|---|
| 197,645 | 11/1877 | Lyons . | |
| 496,428 | 5/1893 | Morgan . | |
| 524,619 | 8/1894 | Sturm . | |
| 734,974 | 7/1903 | Shoosmith . | |
| 752,248 | 2/1904 | Nickerson . | |
| 1,497,686 | 6/1924 | Johnson . | |
| 2,082,889 | 6/1937 | Hight . | |
| 3,485,383 | 12/1969 | Beduhn . | |
| 3,713,544 | 1/1973 | Wallace et al. . | |
| 3,878,944 | 4/1975 | Beduhn et al. . | |
| 3,955,684 | 5/1976 | Novotny | 212/178 |
| 4,195,740 | 4/1980 | Beduhn et al. . | |
| 4,196,816 | 4/1980 | Dvorsky et al. . | |
| 4,243,148 | 1/1981 | Lampson . | |
| 4,258,852 | 3/1981 | Juergens . | |
| 4,280,627 | 7/1981 | Becker . | |
| 4,336,889 | 6/1982 | McGrew . | |
| 4,381,060 | 4/1983 | Morrow, Sr. et al. . | |
| 4,382,519 | 5/1983 | Beduhn et al. . | |
| 4,387,814 | 6/1983 | Beduhn et al. . | |
| 4,394,911 | 7/1983 | Wittman et al. . | |
| 4,446,976 | 5/1984 | Imerman et al. . | |
| 4,483,448 | 11/1984 | Wittman et al. . | |
| 4,679,336 | 7/1987 | Brocklebank et al. . | |
| 4,711,358 | 12/1987 | Konishi . | |
| 4,716,728 | 1/1988 | Kakeya . | |
| 4,716,729 | 1/1988 | Kakeya . | |
| 4,729,486 | 3/1988 | Petzold et al. . | |
| 4,953,722 | 9/1990 | Becker et al. . | |
| 5,199,583 | 4/1993 | Weider et al. | 212/178 |
| 5,522,515 | 6/1996 | Pech et al. . | |
| 5,598,935 | 2/1997 | Harrison et al. | 212/178 |

FOREIGN PATENT DOCUMENTS

| | | |
|---|---|---|
| 0 368 463 | 5/1990 | European Pat. Off. . |
| 2 050 295 | 1/1981 | United Kingdom . |

OTHER PUBLICATIONS

Brochure entitled, "Move the Heavyweights", 2 pages, published by Hilman Rollers, Apr. 1994.

Brochure entitled, "HY–SPEC", 5 pages, published by Nicolas, circa 1992.

*Primary Examiner*—Thomas J. Brahan

*Attorney, Agent, or Firm*—Steven P. Shurtz; Brinks Hofer Gilson & Lione

[57] ABSTRACT

A ring-supported lift crane is provided with a counterweight handling system to facilitate repositioning of the crane. The ring-supported crane includes a ring, a crane upper works and a crane lower works, a boom supported on rollers on the ring and a counterweight assembly also supported on rollers on the ring. The counterweight assembly preferably includes a counterweight carrier on which at least one stack of counterweight boxes or units are placed. A counterweight holder is interposed between the at least one stack of counterweight units and the counterweight carrier with a friction reduction device, such as rollers or slider pads, interposed between the counterweight holder and the counterweight carrier. When the ring-supported crane is to be repositioned for a second lift at a construction site, the counterweight holder with the stack of counterweight units is moved off of the counterweight carrier onto a separate counterweight support member, which may be mobile or stationary. This speeds up the relocation process, as the counterweight units do not have to be individually unstacked before the ring and crane can be moved.

26 Claims, 7 Drawing Sheets

COUNTERWEIGHT HANDLING SYSTEM FOR RING SUPPORTED CRANES

BACKGROUND OF THE INVENTION

The present invention relates to a counterweight handling system for load handling equipment, and more particularly to a counterweight handling system for ring-supported lift cranes.

Efforts to increase the lift capacity of cranes without requiring extensive modification of the basic crane components led to the development of an auxiliary support for cranes as disclosed in U.S. Pat. No. 3,485,383. This invention used an annular circular support, often called a ring, on which the load handling boom and counterweight were both supported on rollers. The basic crane upper works and lower works fit within the ring and the lower works was connected thereto. The upper works was rigidly connected to the boom and counterweight so that as the upper works swung with respect to the lower works, the boom and counterweight traveled around the ring. In this way a basic crane could be outfitted to handle larger lifts because the distance between the pivot point of the boom and the counterweight was increased and, since the counterweight was not carried on the upper works, larger amounts of counterweight could be used without modification of the upper works and its ring gear connection to the lower works.

Numerous other crane designs have taken advantage of the ring support system. For example, see U.S. Pat. Nos. 4,483,448; 4,196,816; 4,387,814; and 4,446,976. Cranes built by the Manitowoc Company, Inc. that use this system use the trademark RINGER, and such cranes are often referred to as RINGER cranes.

The ring allows the crane to swing when it is in position at a job site, and thus pick up a load and move it to its placement position. To move a ring-supported lift crane from one lift site to a second lift site, however, requires removing the counterweight from off of the support ring. If the second site is near to the first site, conventional crawler type tracks on the lower works are used to move the crane, with the ring attached, to the second lift site.

Because most cranes are moved between construction jobs, the cranes are designed to be transported, which means that they are made of components that meet weight limits imposed on highway transportation. Thus, typically the counterweight is made of numerous counterweight units. For example, a crane having removable counterweights with a total weight of 1,144,000 pounds could use 26 counterweight units or boxes of 44,000 pounds each, which is a convenient weight for an assist crane and is the maximum allowable transport weight for many highways.

When it is time to move a ring-supported lift crane from one lift site on a construction job to another site, an assist crane is used to unload counterweight units one at a time and set them aside. Then after the crane and ring had been repositioned, the assist crane makes repeated trips between the sites, moving the individual counterweight units and restacking the counterweight units onto the counterweight carrier of the repositioned crane. While the counterweight moving procedure is time consuming in and of itself, the overall length of time it takes to reposition the ring-supported lift crane is dependent on this procedure because removing the counterweight units must take place before many other steps of preparing the crane for repositioning can occur, and reinstalling the counterweight has to wait until after the reverse of those many steps has taken place. Thus there is a need for an improved counterweight handling system for ring-supported lift cranes.

SUMMARY OF THE INVENTION

An improved counterweight handling system has been invented which allows the counterweight units to be off loaded and reinstalled on the ring and crane assembly while stacked up, thus obviating the need, and associated delay, in removing or reinstalling the counterweight units one at a time.

In one aspect, the invention is a load handling system comprising an arcuate support member, a load handling boom on the arcuate support member and a stack of counterweight units on a counterweight carrier also on the arcuate support member, the improvement comprising a counterweight holder interposed between the stack of counterweight units and the counterweight carrier; and at least one roller assembly interposed between the counterweight carrier and the counterweight holder.

In a second aspect, the invention is a ring and crane assembly with improved counterweight handling capabilities comprising:

a) a ring;

b) a crane with upper works mounted on lower works so as to be able to rotate with respect to the lower works about a generally vertical swing axis, the swing axis being concentric with the center of the ring and the lower works being rigidly connected to the ring;

c) a load handling boom supported by rollers on the ring and rigidly connected to the upper works so as to swing therewith; and d) a counterweight assembly supported by rollers on the ring and rigidly connected to the upper works to swing therewith, the counterweight assembly comprising:

i) a counterweight carrier to which said rollers supporting the counterweight assembly on the ring are attached;

ii) one or more counterweight holders supporting a plurality of counterweight units thereon; and iii) a friction reduction device interposed between the one or more counterweight holders and the counterweight carrier to allow the one or more counterweight holders to be moved off of the counterweight carrier while the plurality of counterweight units remain on the one or more counterweight holders.

In a third aspect, the invention is a method of moving a ring-supported crane from a first lift site to a second lift site, the ring-supported crane comprising a ring, a boom supported on and moveable around the ring and a counterweight assembly supported on and moveable around the ring; the counterweight assembly comprising a counterweight carrier, a counterweight holder on the counterweight carrier and a plurality of counterweight units supported on the counterweight holder, the method comprising the steps of:

a) moving the counterweight holder with the plurality of counterweight units still supported thereon from off of the counterweight carrier onto a separate counterweight support member;

b) moving the ring, boom and counterweight carrier without the counterweight holder thereon from the first lift site to the second lift site;

c) moving the counterweight holder and plurality of counterweight units to the second lift site; and d) placing the counterweight holder and plurality of counterweight units back onto the counterweight carrier.

In one embodiment, the counterweight support member onto which the counterweight holder and plurality of counterweight units are off-loaded is stationary. However, in a second embodiment, the counterweight support member comprises a transport vehicle capable of carrying the weight of the entire stack of counterweight units. The transport vehicle is thus used to move the counterweight units as a group, avoiding the need for an assist crane to move the counterweight units. In either embodiment, the job site relocation time is reduced because the relocation of the counterweight and the ring-supported lift crane can occur simultaneously.

These and other advantages of the invention, as well as the invention itself, will be best understood in view of the attached drawings.

DETAILED DESCRIPTION OF THE DRAWINGS AND PRESENTLY PREFERRED EMBODIMENTS

Figure 1:
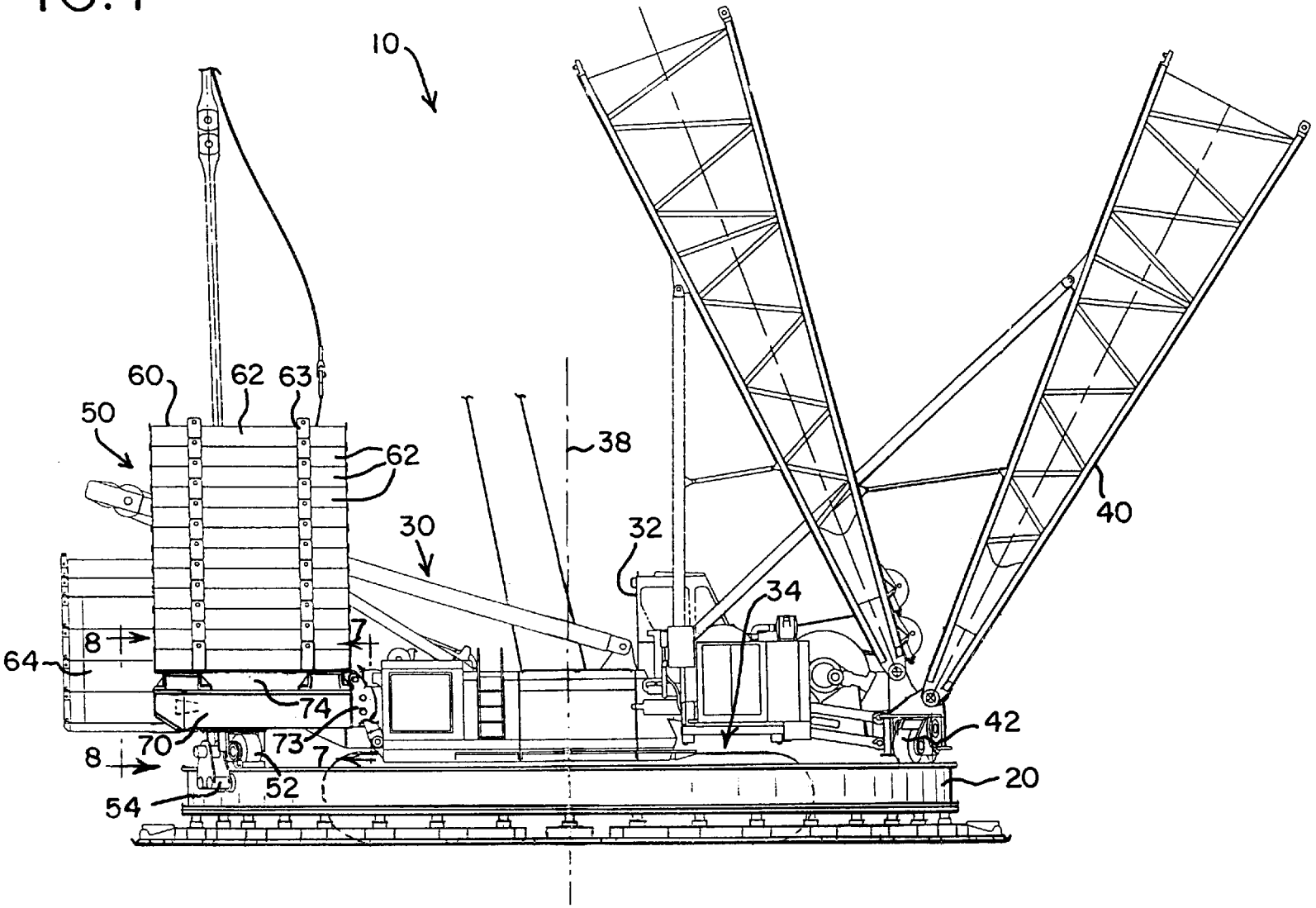
FIG. 1 is a side elevational view of the major components of a preferred ring and crane assembly of the present invention.
Figure 2:
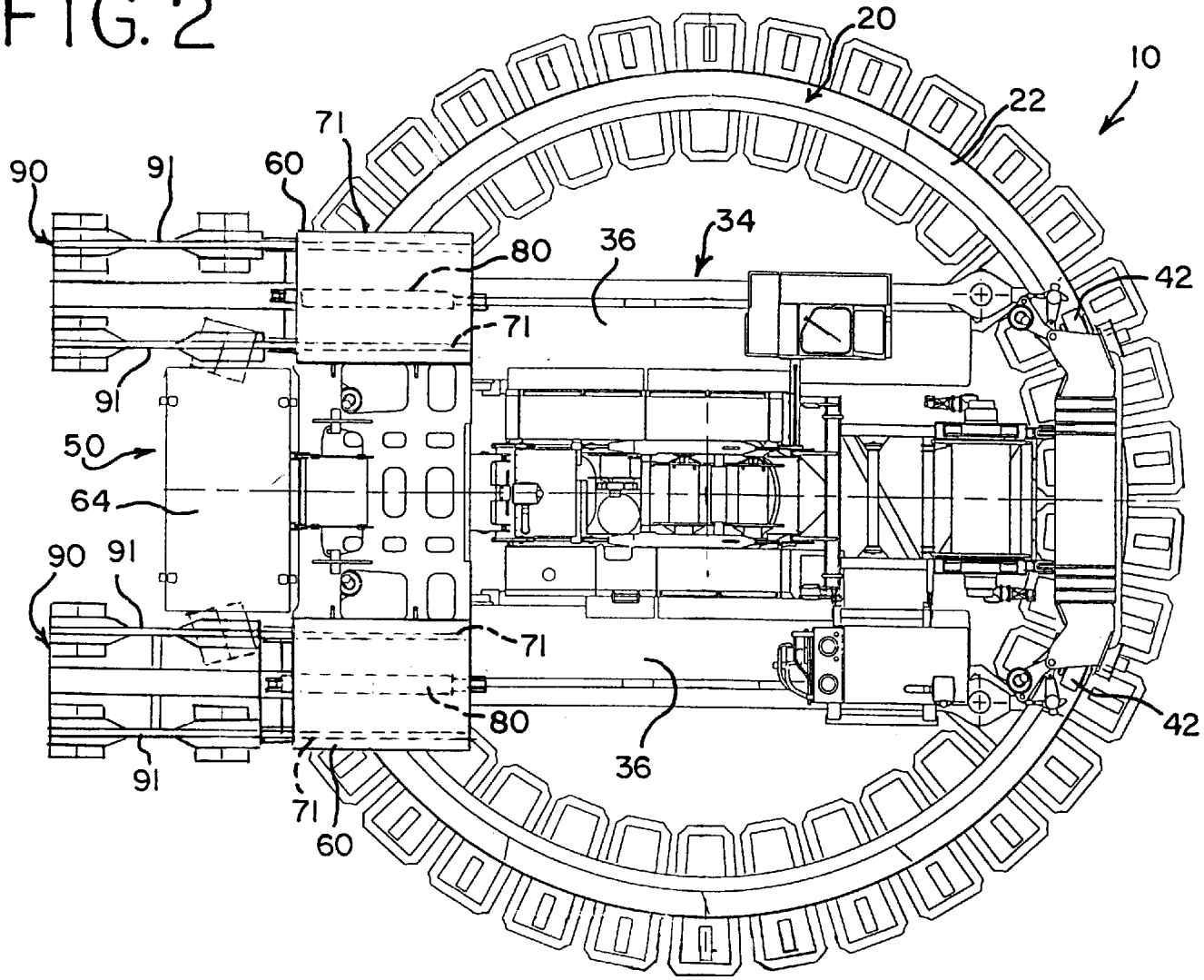
FIG. 2 is a top plan view of the assembly of FIG. 1 with some of the crane components removed for sake of clarity and showing two counterweight support members in position to receive the two stacks of counterweight.

A preferred embodiment of the load handling system of the present invention is ring-supported lift crane such as the ring and crane assembly 10 shown in FIGS. 1 and 2. The crane depicted is a Model 888 RINGER crane from Manitowoc. The ring 20 serves as an arcuate shaped support member. The ring 20 has a smooth, annular top surface 22. As shown in FIG. 1, the ring 20 is supported by pedestals. In this fashion the ring 20 is resting, at least indirectly, on the ground. During lifting operations the ring 20 is thus stationary.

Inside of the ring 20 is a crane 30. The crane 30 includes an upper works 32 and a lower works 34 (mostly obscured by the ring 20 in FIG. 1). The lower works 34 preferably includes conventional crawler-type tracks 36 (FIG. 2). The upper works 32 is mounted to rotate on the lower works 34 about a swing axis 38. The swing axis is concentric with the center of the ring 20. The lower works 34 is rigidly connected to the ring 20 in a conventional manner, with the crawler-type tracks 36 being surrounded by the ring 20.

A load handling boom 40 (only the lower portion of which is shown in FIG. 1) is supported on rollers 42 resting on the top surface 22 of the ring 20. As shown in FIG. 1, the boom 40 is rigidly connected to the upper works 32 so as to move around the ring 20 and thus swing with the upper works 32 as the upper works 32 rotates about swing axis 38.

A counterweight assembly 50 is also supported on rollers 52 resting on the top surface 22 of the ring 20, and is rigidly connected to the upper works 32 so as to move around the ring 20 and thus swing with the upper works 32. A hook roller assembly 54 is preferably connected to rollers 52 so that during heavy lift operations, the weight of the ring 20 can also be used to prevent tipping of the crane.

Other than the counterweight assembly, the remainder of the crane components can be conventional, such as those of the Model 888 crane depicted in FIG. 1. The boom 40 may be made according to the teachings of U.S. Pat. Nos. 5,406,767 and 5,199,586. The crawlers 36 may attach to the rest of the lower works as disclosed in U.S. patent application Ser. No. 08/469,194. The control system for the various hydraulically powered components of the crane can include the features disclosed in U.S. Pat. Nos. 5,189,605; 5,297,019 and 5,579,931. The hydraulic system may use a multi-coupling device as disclosed in U.S. Pat. No. 5,148,929. The ring 20 may be constructed according to the disclosure of U.S. Pat. No. 5,522,515. Each of the foregoing patents and application are hereby incorporated by reference. Since these components of the ring and crane assembly may be conventional, they are not described in further detail.

The preferred embodiment of the present invention relates to an improvement in the counterweight assembly 50. In a typical ring-supported crane, there are counterweight components added to the system and counterweight that is part of the basic crane. In the ring and crane assembly 10, the counterweight assembly includes two side stacks 60 of counterweight units 62 which are added to the system and counterweight 64 that includes the basic crane counterweight typically carried on the crane upper works 32. However, when the crane is set up in the RINGER configuration, counterweight 64 is located between the two side stacks 60 (FIG. 2). The counterweight stacks 60 in the Model 888 RINGER crane not using the present invention rest directly on a counterweight carrier 70 to which the rollers 52 are attached. However, in the present invention, a counterweight holder 74 is interposed between the stacks 60 of counterweight units 62 and the counterweight carrier 70. Preferably, one counterweight holder 74 is used for each stack of counterweight 60. The counterweight units 62 are arranged and supported on the counterweight holder 74 in the same way they are normally arranged and supported on the counterweight carrier 70. Each counterweight unit 62 preferably includes alignment tabs 63 to align one counterweight box or unit 62 to the counterweight unit 62 above it in the stack. The tabs 63 include holes which facilitate handling the individual counterweight units 62. Similar tabs 63 are included on the counterweight holder 74 (FIGS. 4–8) for aligning the counterweight units 62 on the counterweight holders 74.

In the apparatus of the present invention, a friction reduction device is interposed between each counterweight holder 74 and the counterweight carrier 70. The preferred friction reduction device is a roller assembly. As best seen in FIGS. 4, 6, 7 and 8, preferably four roller assemblies 76 (a and b) are secured to the bottom of each of the counterweight holders 74. These roller assemblies include a plurality of rollers 77 (best seen in FIGS. 11–14) that are interposed between the counterweight holder 74 and the counterweight carrier 70 when the ring and crane assembly 10 is in its operational (lift) configuration. The rollers 77 allow the counterweight holders 74 to be rolled off of the counterweight carrier 70 while the plurality of counterweight units 62 remain on the counterweight holders 74.

Figure 6:
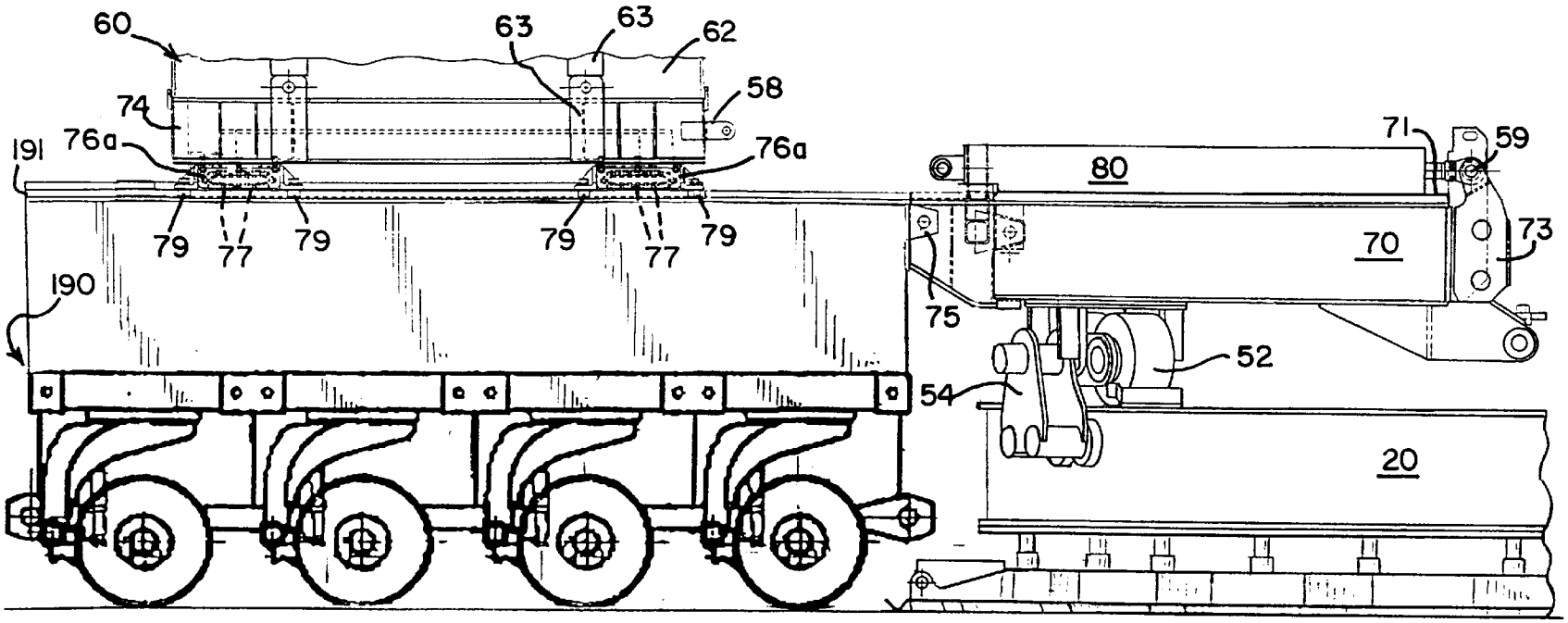
FIG. 6 is a side elevational view similar to FIG. 4 but showing a second embodiment of the invention using a transport vehicle.

In the preferred method of the present invention, each of the counterweight holders 74 with counterweight units 62 supported thereon is rolled off of the counterweight carrier 70 onto either a stationary counterweight support member 90 (FIG. 4) or onto a counterweight support member 190 that includes wheels and thus comprises a transport vehicle (FIG. 6).

The top surfaces of the counterweight carrier 70 and the counterweight support members 90 or 190 preferably include one or more guide rails 71 and 91 or 191 respectively. The rollers 77 roll on the guide rails 71 while the counterweight holders 74 are rolled off of the counterweight carrier 70. Preferably, the two roller assemblies 76*a* on the outward side of each counterweight holder 74 include guide rollers 79 that fit on either side of the guide rails 71, 91, 191, to cooperate with the guide rails 71 and 91 or 191 and guide the counterweight holders 74 as they are rolled between the counterweight carrier 70 and the support members 90 or 190. In this regard the guide rails 91 or 191 on top of the counterweight support members 90 or 190 match up in dimension and position with the guide rails 71 of the counterweight carrier 70. The other two roller assemblies 76*b* do not need guide rollers.

Figure 3:
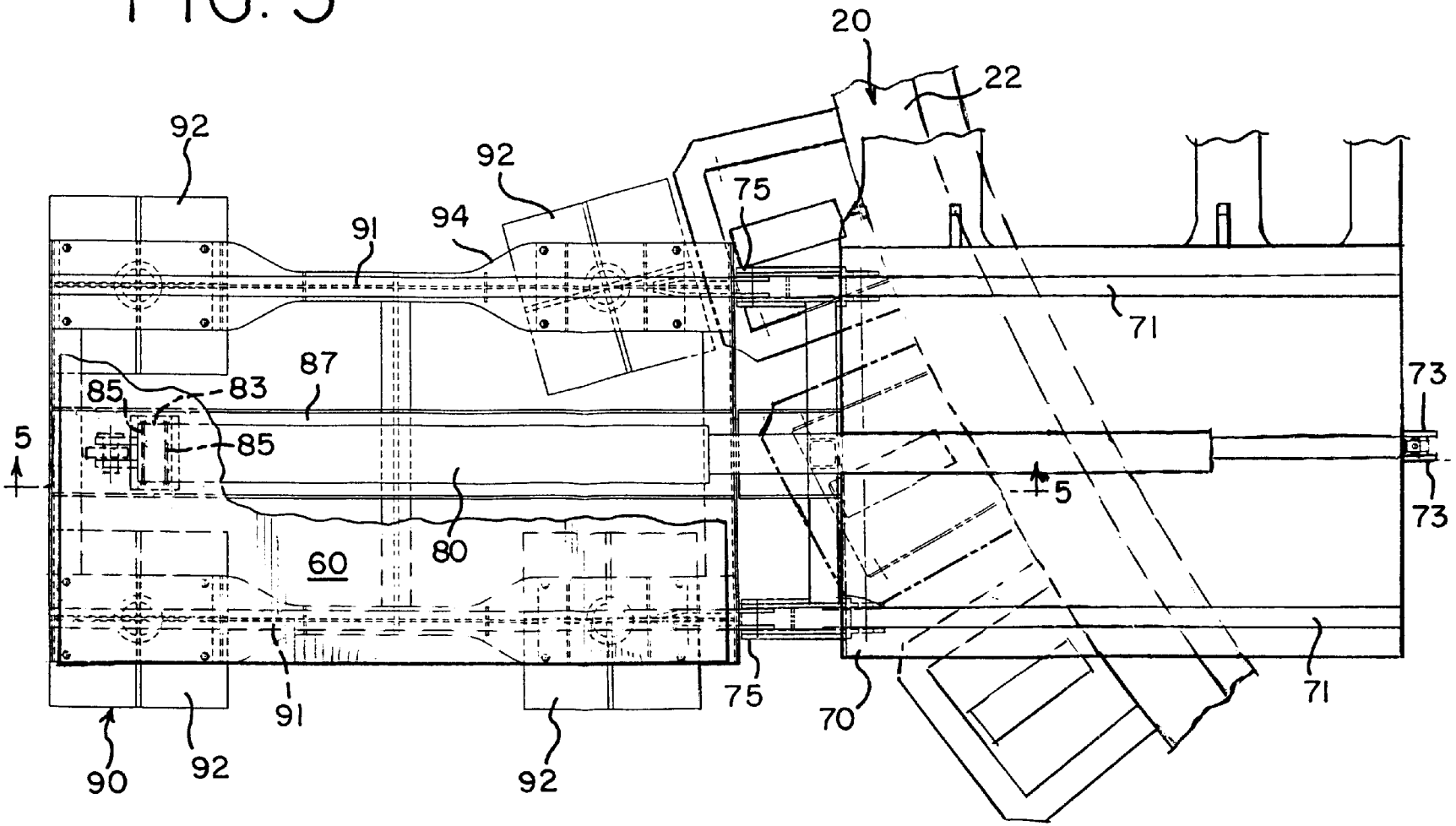
FIG. 3 is an enlarged, partial top plan view of the assembly of FIG. 2 showing one counterweight holder and counterweight support member.
Figure 4:
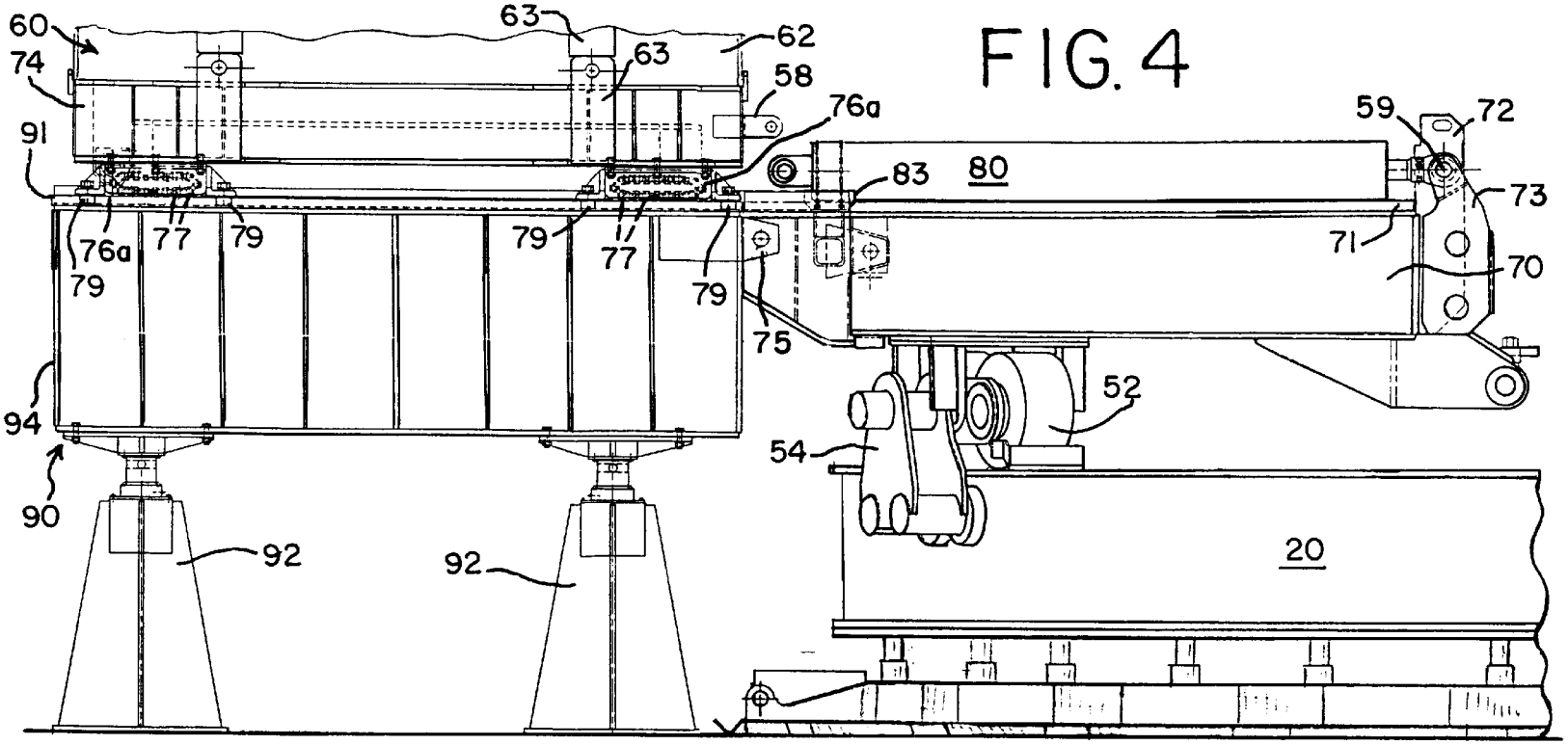
FIG. 4 is an enlarged, partial side elevational view of a counterweight support member with a counterweight holder thereon, the counterweight support member being pinned to the counterweight carrier.

During the transfer of the counterweight holder 74, the counterweight support members 90 or 190 are preferably pinned to the counterweight carrier 70 by pins 75, best seen in FIGS. 3, 4 and 6. The placement of the pin holes in flanges on the counterweight carrier 70 and on counterweight support members 90, 190 assures that the top surfaces, and hence the guide rails 91, 191 of the counterweight support members 90, 190 are even with the top surface and hence the guide rails 71 of the counterweight carrier 70.

Each stationary counterweight support member 90 preferably comprises a weldment 94 supported on four pedestal supports 92 (FIGS. 3 and 4). Each pedestal 92 preferably include a leveling jack screw in order to be able to level the weldment 94 to be even with the counterweight carrier 70 when pins 75 are inserted. The mobile vehicle counterweight support member 190 also preferably includes a jacking and leveling system.

Figure 7:
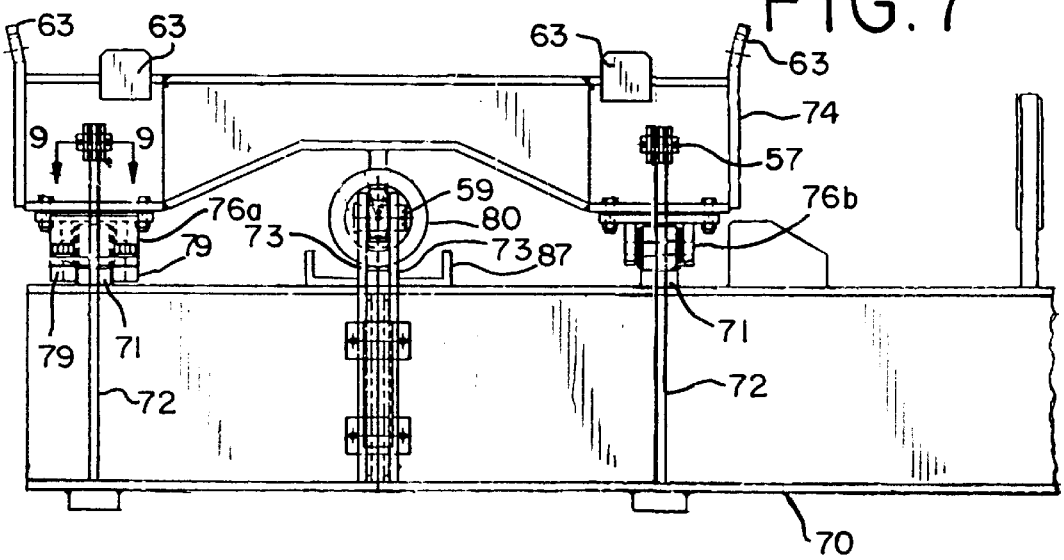
FIG. 7 is a cross-sectional view taken along line 7—7 of FIG. 1.
Figure 8:
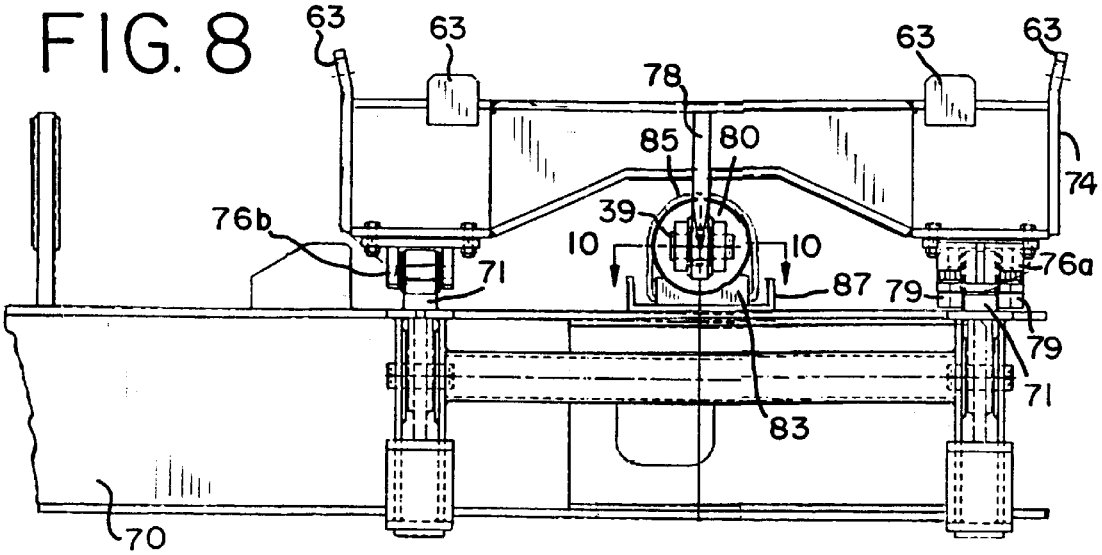
FIG. 8 is a cross-sectional view taken along line 8—8 of FIG. 1.
Figure 10:
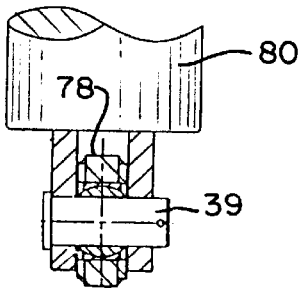
FIG. 10 is a cross-sectional view taken along line 10—10 of FIG. 8.
Figure 12:
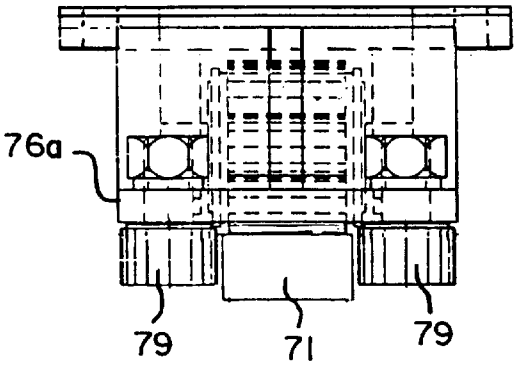
FIGS. 11 and 12 are enlarged elevational views showing one of the roller assemblies used on the counterweight holder of FIGS. 7 and 8.
Figure 14:
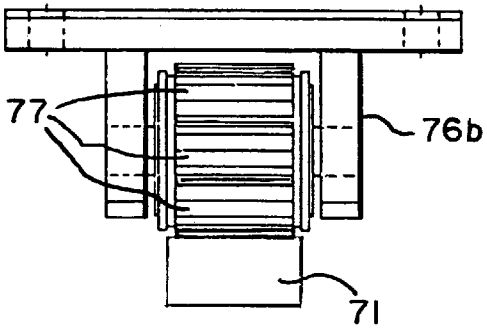
FIGS. 13 and 14 are enlarged elevational views showing another roller assembly used on the counterweight holder of FIGS. 7 and 8.
Figure 11:
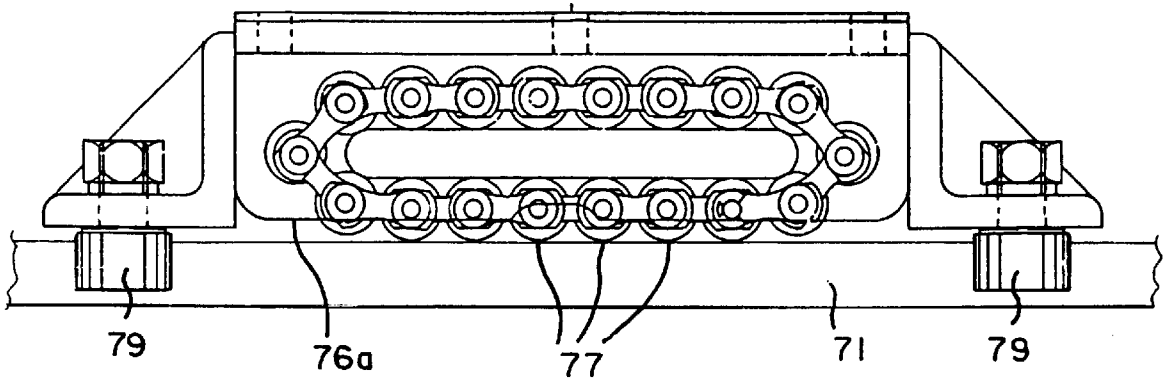
Figure 13:
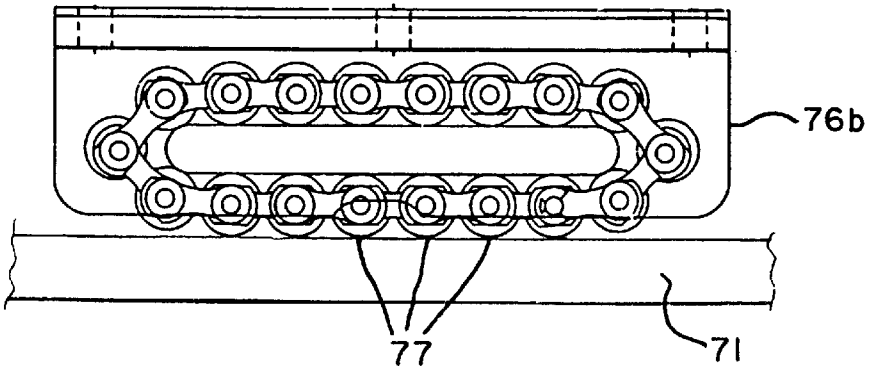

The counterweight assembly 50 preferably includes at least one telescoping hydraulic cylinder 80 (FIGS. 2–8) for each counterweight holder 74. Each cylinder 80 is preferably pinned between a counterweight holder 74 on one end and the counterweight carrier 70 on the other end. In this way the cylinders 80 can be used to move the counterweight holders 74 onto and off of the counterweight support members 90 or 190 from the counterweight carrier 70. On the one end, the cylinders 80 are secured by pins 59 to the counterweight carrier 70 through two parallel cylinder support plates 73 welded to the counterweight carrier 70 (FIGS. 4, 6 and 7). On the other end, the cylinders 80 are secured by pins 39 to the counterweight holders 74 through a plate 78 extending downwardly from the center back end of the counterweight holder 74 (FIGS. 8 and 10).

Figure 5:
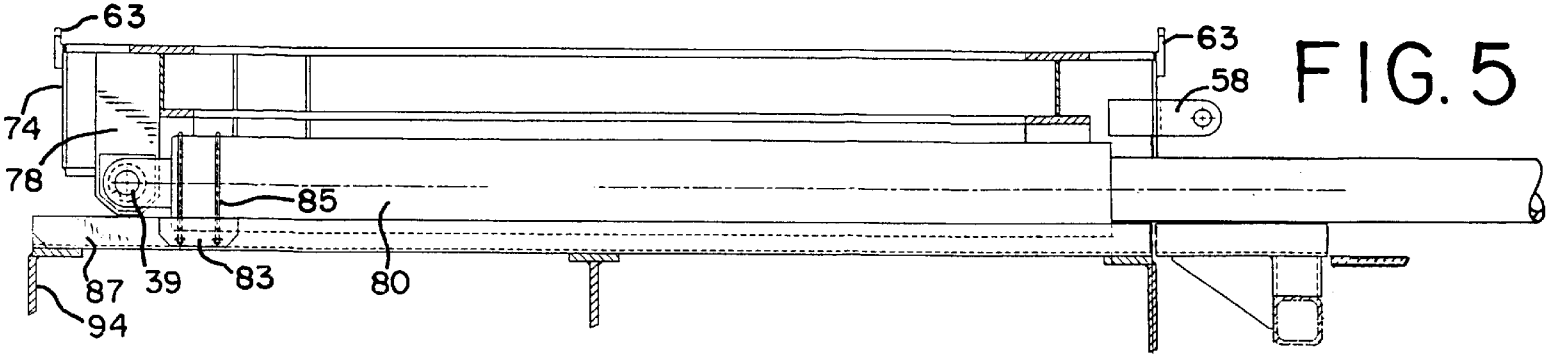
FIG. 5 is a cross-sectional view taken along line 5—5 of FIG. 3.
Figure 9:
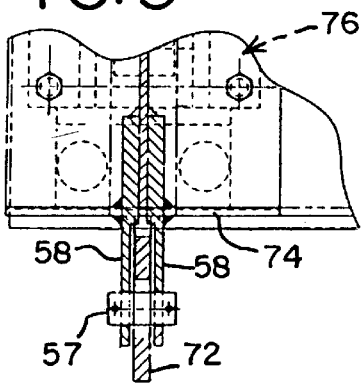
FIG. 9 is a is cross-sectional view taken along line 9—9 of FIG. 7.

During normal lift operation of the crane, the cylinders 80 are pinned in place but not used. In addition, the counterweight holders 74 are pinned to the counterweight carrier 70 by pins 57 through holes in flanges 58 mounted on the end of counterweight holder 74 and extensions 72 welded to the counterweight carrier 70 (see FIGS. 7 and 9). When the counterweight holders 74 are to be rolled off of the counterweight carrier 70, the pins 57 are removed. The cylinders 80 are then extended. The counterweight holders 74 are thereby pushed off of the counterweight carrier 70 onto the counterweight support members 90 or 190. After the counterweight holders are secured to the counterweight support members 90 or 190, the pins 39 are removed and the cylinders 80 are retracted. As best seen in FIGS. 5 and 8, a slider pad 83 is secured by U-bolts 85 onto the end of the cylinder 80 to support the end of cylinder 80 while it is retracted. A flanged slide path member 87 is preferably included on the top of weldment 94 to guide the slider pad 83 and hence the cylinder 80 while it is retracted. Of course, if the cylinder 80 is used to pull counterweight holder 74 onto the counterweight carrier 70, the reverse steps are used.

The preferred method of the present invention allows repositioning of the ring and crane assembly 10 between a first lift site and a second lift site with a minimum of disassembly and reassembly time. As noted above, first the stacks 60 of counterweight on the counterweight holders 74 are moved from off of the counterweight carrier 70 onto the separate counterweight support members 90 or 190. The crawlers 36 on the basic crane are then used to move the crane 30 with the ring 20, boom 40 and counterweight carrier 70, with only the middle portion of counterweight 64, to the second lift site as one assembly. Before, after or during this move, the counterweight units 62 are also moved to the new lift site. Of course, if a mobile counterweight support member 190 is used, the process of moving the counterweight stack 60 can proceed rapidly and without an assist crane. Otherwise, once the crane 30 and ring 20 are repositioned, either a different counterweight holder 74 can be pinned onto the counterweight carrier 70 and the counterweight unit 62 stacked thereon, or the counterweight units 62 can be moved off of the counterweight holder 74, transported to the second lift site and set on the ground and then the original counterweight holder 74 can be reused. While this last alternative is not the quickest, it is still faster than prior art methods that required the counterweight units to be lifted one at a time off of the counterweight carrier, because the unstacking and moving operation can occur while the basic crane is also being moved.

If an extra stationary counterweight support member 90 is available, as well as an extra counterweight holder 74, the counterweight units 62 can be restacked on the extra counterweight holder 74 while it is on the extra counterweight support member 90, and then the entire stack of counterweight rolled back onto the counterweight carrier 70 at the second lift site, just as if it had been transported on a mobile counterweight support member 190.

Another advantage of the use of a mobile counterweight support member 190 would be during the initial crane setup. The ring 20 and crane 30 would be assembled simultaneously to the counterweight being stacked onto the mobile counterweight support member 190. The side stack of counterweight 60 could then be brought into place and conveniently rolled onto the counterweight carrier 70.

The presently preferred mobile counterweight support member 190 comprises a hydraulic, self-powered, electronically controlled HY-SPEC™ transporter system, sold by Nicolas, B.P.3 90290 Champs-Sur-Yonne, France. The preferred roller assemblies are sold by Hillman Rollers, 2604 Atlantic Avenue, Wall, N.J. 07719.

While the preferred embodiments of the invention have been described herein, there are numerous changes that could be made that would use equivalent structures or method steps. For example, instead of using roller assemblies 76, low friction slider pads made of nylon or other suitable material could be used as the friction reduction device between the counterweight holders 74 and the counterweight carrier 70. The counterweight carrier 70, which is shown as a single unit to which the crane back hitch connects, could be made of multiple components. A first component would stay with the crane and the other components, with stacks of counterweight thereon, would be disconnected from the first component and moved off of the ring.

It should be appreciated that the apparatus and methods of the present invention are thus capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. A ring and crane assembly with improved counterweight handling capabilities comprising:

a) a ring;

b) a crane with upper works mounted on lower works so as to be able to rotate with respect to the lower works about a generally vertical swing axis, the swing axis being concentric with the center of the ring, the lower works being rigidly connected to the ring and including crawler-type tracks within said ring;

c) a load handling boom supported by rollers on the ring and rigidly connected to the upper works so as to swing therewith; and d) a counterweight assembly supported by rollers on the ring and rigidly connected to the upper works to swing therewith, the counterweight assembly comprising:

i) a counterweight carrier to which said rollers supporting the counterweight assembly on the ring are attached;

ii) one or more counterweight holders supporting a plurality of counterweight units thereon; and iii) a friction reduction device interposed between the one or more counterweight holders and the counterweight carrier to allow the one or more counterweight holders to be moved off of the counterweight carrier while the plurality of counterweight units remain on the one or more counterweight holders.

2. The ring and crane assembly of claim 1 wherein the counterweight assembly comprises two counterweight holders each with a stack of counterweight units thereon.

3. The ring and crane assembly of claim 2 further comprising additional counterweight located between the two stacks of counterweight units.

4. The ring and crane assembly of claim 1 wherein the counterweight assembly further comprises at least one hydraulic cylinder for each counterweight holder, the cylinder being connected between the counterweight carrier and the counterweight holder for moving the holder onto and off of the carrier.

5. The ring and crane assembly of claim 1 wherein the friction reduction device comprises rollers secured to the bottom of the one or more counterweight holders.

6. The ring and crane assembly of claim 5 wherein the rollers on the bottom of the one or more counterweight holders comprise four roller assemblies.

7. The ring and crane assembly of claim 1 further comprising a counterweight support member pinned to the counterweight carrier, the counterweight support member having a top surface level with the top surface of the counterweight carrier so that the friction reduction device interposed between the one or more counterweight holders and the counterweight carrier can move from the counterweight carrier to the counterweight support member.

8. The ring and crane assembly of claim 7 wherein the counterweight support member is a stationary device.

9. The ring and crane assembly of claim 7 wherein the counterweight support member comprises a transport vehicle.

10. The ring and crane assembly of claim 5 wherein the counterweight carrier includes one or more guide rails on which the rollers secured to the bottom of the one or more counterweight holders roll while the one or more counterweight holders are rolled off the counterweight carrier.

11. The ring and crane assembly of claim 10 wherein the rollers secured to the bottom of the one or more counterweight assemblies are configured in a plurality of roller assemblies, at least one of which includes guide rollers that cooperate with the guide rail to guide the counterweight holder as it is rolled off of the counterweight carrier.

12. The ring and crane assembly of claim 11 further comprising a counterweight support member pinned to the counterweight carrier, the counterweight support member having a top surface and a guide rail that are level and match with the top surface and guide rail of the counterweight carrier so that the guide rollers guide the counterweight holder as the counterweight holder is rolled off of the counterweight carrier and onto the counterweight support member.

13. The ring and crane assembly of claim 2 further comprising two hydraulic cylinders, each hydraulic cylinder being pinned between the counterweight carrier and one of the counterweight holders.

14. In a load handling system comprising an arcuate support member resting, at least indirectly, on the ground, a load handling boom on the arcuate support member and a stack of counterweight units on a counterweight carrier also on the arcuate support member, the improvement comprising:

a) a counterweight holder interposed between the stack of counterweight units and the counterweight carrier;

b) at least one roller assembly interposed between the counterweight carrier and the counterweight holder; and c) a hydraulic cylinder connected between the counterweight carrier and the counterweight holder.

15. A method of moving a ring-supported crane from a first lift site to a second lift site, the ring-supported crane comprising a ring, a boom supported on and moveable around the ring and a counterweight assembly supported on and moveable around the ring; the counterweight assembly comprising a counterweight carrier, a counterweight holder on the counterweight carrier and a plurality of counterweight units supported on the counterweight holder, the method comprising the steps of:

a) moving the counterweight holder with the plurality of counterweight units still supported thereon from off of the counterweight carrier onto a separate counterweight support member;

b) moving at least a portion of the ring, the boom and the counterweight carrier without the counterweight holder thereon from the first lift site to the second lift site as one assembly;

c) moving the counterweight holder and plurality of counterweight units to the second lift site; and d) placing the counterweight holder and plurality of counterweight units back onto the counterweight carrier.

16. The method of claim 15 wherein the plurality of counterweight units are on the counterweight holder when the counterweight holder is placed onto the counterweight carrier in step d).

17. The method of claim 15 wherein step c) precedes step b) in time.

18. The method of claim 15 wherein the counterweight support member comprises a transport vehicle which also transports the counterweight holder and counterweight units during step c).

19. The method of claim 15 wherein the counterweight support member comprises a stationary counterweight support member and the counterweight units are moved with an assist crane from the stationary counterweight support member and placed onto a second counterweight holder during step c).

20. The method of claim 19 wherein the second counterweight holder is on a second stationary counterweight support member while the counterweight units are placed thereon by the assist crane.

21. The method of claim 19 wherein the second counterweight holder is on the counterweight carrier at the second lift site while the counterweight units are placed thereon by the assist crane.

22. The method of claim 15 wherein the counterweight holder has rollers mounted thereon and the counterweight holder is rolled off of the counterweight carrier onto the counterweight support member through the use of said rollers.

23. In a load handling system comprising an arcuate support member, a load handling boom on the arcuate support member, a crane lower works including crawlers, the lower works being attached to the arcuate support member so that the arcuate support member surrounds the crawlers and can be transported by the lower works, and a stack of counterweight units on a counterweight carrier also on the arcuate support member, the improvement comprising:

a) a counterweight holder interposed between the stack of counterweight units and the counterweight carrier;

b) at least one roller assembly interposed between the counterweight carrier and the counterweight holder.

24. The load handling system of claim 23 further comprising a hydraulic cylinder connected between the counterweight carrier and the counterweight holder.

25. A method of moving a ring-supported crane from a first lift site to a second lift site, the ring-supported crane comprising a ring, a boom supported on and moveable around the ring and a counterweight assembly supported on and moveable around the ring; the counterweight assembly comprising a counterweight carrier, a counterweight holder on the counterweight carrier and a plurality of counterweight units supported on the counterweight holder, the method comprising the steps of:

a) moving the counterweight holder with the plurality of counterweight units still supported thereon from off of the counterweight carrier onto a separate counterweight support member which comprises a transport vehicle;

b) moving the ring, boom and counterweight carrier without the counterweight holder thereon from the first lift site to the second lift site;

c) moving the counterweight holder and plurality of counterweight units on said transport vehicle; and d) placing the counterweight holder and plurality of counterweight units back onto the counterweight carrier.

26. A method of moving a ring-supported crane from a first lift site to a second lift site, the ring-supported crane comprising a ring, a boom supported on and moveable around the ring and a counterweight assembly supported on and moveable around the ring; the counterweight assembly comprising a counterweight carrier, a counterweight holder on the counterweight carrier and a plurality of counterweight units supported on the counterweight holder, the method comprising the steps of:

a) moving the counterweight holder with the plurality of counterweight units still supported thereon from off of the counterweight carrier onto a separate, stationery counterweight support member;

b) moving the ring, boom and counterweight carrier without the counterweight holder thereon from the first lift site to the second lift site;

c) moving the plurality of counterweight units to the second lift site by moving the counterweight units with an assist crane onto a second counterweight holder; and d) placing the counterweight holder and plurality of counterweight units back onto the counterweight carrier.

* * * * *